United States Patent [19]

Romaine

[11] Patent Number: 4,624,320

[45] Date of Patent: Nov. 25, 1986

[54] FIRE BLANKET

[76] Inventor: John W. Romaine, 58897 Cr 115, Goshen, Ind. 46516

[21] Appl. No.: 609,931

[22] Filed: May 14, 1984

Related U.S. Application Data

[63] Continuation-in-part of Ser. No. 568,852, Jan. 6, 1984, abandoned.

[51] Int. Cl.[4] ..... A62C 7/00

[52] U.S. Cl. ..... 169/50; 252/608

[58] Field of Search ..... 169/50; 427/290, 291, 427/393, 280; 428/40, 41, 42, 139; 128/165, 166, 291, 368; 523/56, 62; 252/608, 609; 378/38; 250/455.1

[56] References Cited

U.S. PATENT DOCUMENTS

| | | | |
|---|---|---|---|
| 1,035,190 | 8/1912 | Hill | 428/139 X |
| 1,944,834 | 1/1934 | Bennett | 428/139 |
| 2,071,921 | 2/1937 | Dickson | 428/139 |
| 2,428,716 | 1/1942 | McGill et al. | 428/290 X |
| 2,496,349 | 2/1956 | Kellgren et al. | 428/40 |
| 2,550,134 | 3/1948 | Balaasa et al. | 428/921 X |
| 2,599,359 | 6/1965 | Bank et al. | 428/40 X |
| 2,691,567 | 10/1951 | Knalnes et al. | 525/56 X |
| 2,733,229 | 5/1952 | Bruce | 525/56 X |
| 3,049,389 | 3/1960 | Chappellier | 169/50 X |
| 3,591,543 | 7/1971 | Stafford | 525/62 X |
| 3,637,409 | 1/1972 | Hartman | 427/393.3 X |
| 3,902,559 | 9/1975 | Everingham et al. . | |
| 4,116,702 | 9/1978 | Rohringer et al. | 252/608 X |
| 4,219,595 | 8/1980 | Sponing | 428/40 |
| 4,222,926 | 9/1980 | Mizuno et al. | 525/56 X |
| 4,321,232 | 3/1982 | Bithell | 250/455.1 X |
| 4,349,593 | 9/1982 | Blechstein | 427/393.3 X |
| 4,377,160 | 3/1983 | Romaine . | |
| 4,404,820 | 9/1983 | Romaine | 62/530 |
| 4,473,614 | 9/1984 | Hockmeyer | 428/921 X |

FOREIGN PATENT DOCUMENTS

| | | |
|---|---|---|
| 2055791 | 5/1977 | Japan . |
| 2069975 | 6/1977 | Japan . |
| 3043782 | 4/1978 | Japan . |

*Primary Examiner*—Joseph F. Peters, Jr.
*Assistant Examiner*—Kevin Patrick Weldon
*Attorney, Agent, or Firm*—Flynn, Theil, Boutell & Tanis

[57] ABSTRACT

A fire-retardant appliance, such as a fire blanket or an article of fire-retardant clothing, formed from a sheet-like fire-retardant cloth. This cloth comprises a thin, flexible, sheetlike structure formed by a thin, flexible carrier, such as nonwoven polyester, impregnated with a hydrous gel. When used as a blanket, a release film preferably covers one surface of the blanket and is readily removed therefrom when the blanket is readied for use. When used as a clothing article, a lining film covers one surface of the blanket and is tightly adhered to the gel layer, which lining film defines the inner surface of the clothing article. A release film can also be provided for removably covering the outer surface of the clothing article.

10 Claims, 6 Drawing Figures

FIRE BLANKET

CROSS REFERENCE TO RELATED APPLICATION

This application is a continuation-in-part of copending application Ser. No. 568,852, filed Jan. 6, 1984, now abandoned.

FIELD OF THE INVENTION

This invention relates to a fire-retardant appliance and, in particular, to a fire blanket or an article of fire-retardant clothing.

BACKGROUND OF THE INVENTION

Numerous fire-fighting appliances are known such as foam and powdered extinguishers and asbestos blankets, but such devices possess known deficiencies. For example, such devices are often not suitable for use with or application to a fire victim. Further, many such devices are not suitable for convenient transport and/or do not withstand or properly function after exposure to extreme temperature conditions, such as freezing temperatures.

In an attempt to improve on such appliances and overcome the deficiencies thereof, there has been proposed a fire blanket which must be stored in a container containing a thickened but flowable aqueous solution, which blanket must be removed from the solution-containing container when use of the blanket is required. With this arrangement, however, the overall assembly is both bulky and heavy, in addition to being expensive, and hence this restricts and in fact detracts from usage thereof. Further, the blanket when removed from the container is messy to use due to the thickened flowable solution, and hence this tends to discourage removal of the blanket from the container except in those situations where use of the blanket is believed essential. The blanket itself is also of an extremely complex and hence expensive structure, such as being of a woven wool. This appliance, as disclosed in Pat. No. 3,902,559, hence possesses recognized disadvantages but, nevertheless, has still achieved substantial commercial success inasmuch as no one has, prior to this invention, devised a more desirable fire blanket.

In addition to conventional fire blankets as described above, fire-fighting appliances also include numerous clothing articles such as suits, pants, jackets, boots and gloves used for protecting an individual when fighting a fire. Such clothing has conventionally been constructed of various synthetic materials such as asbestos, aluminized fabrics and the like. Such articles, however, do not always provide protection of the level desired, particularly when exposed to flames or substantial temperature.

Accordingly, it is an object of this invention to provide an improved fire-retardant material incorporating therein a substantial quantity of a solidlike water-base gel, which material is particularly desirable for use as a fire-fighting appliance, such as for a fire blanket or for an article of fire-retardant clothing.

More specifically, it is one object of this invention to provide an improved blanket, particularly a so-called fire blanket, which overcomes the deficiencies associated with prior fire-fighting appliances of this general type. In particular, the improved fire blanket of this invention can be readily and manually applied so as to extinguish small fires, including extinguishing burning clothing on a victim. At the same time, the improved fire blanket of this invention can be readily stored, which blanket when use thereof is desired, can be quickly and easily used by removing the blanket from its protective bag and thereafter unfolding the blanket and removing the plastic film from the one side thereof, whereupon the blanket can then be utilized. The blanket preferably comprises a large flexible sheet of nonwoven fabric which provides the blanket with substantial strength, and which functions as a carrier for a relatively thin layer of polyvinyl alcohol gel. The gel layer preferably has a plastic film removably but lightly adhered to one surface thereof to permit folding of the blanket without creating any self-adherence between the folded layers. The gel layer creates a cool and moist, but not wet or messy, surface which is effective for both smothering a fire and for protecting a person from a fire. Such blanket can be manufactured relatively inexpensively, and can be conveniently and compactly stored and transported without requiring special handling or containers.

It is another object of this invention to provide an improved article of fire-retardant clothing, which article is believed to represent a significant improvement over conventional clothing articles of this general type. This improved article of clothing is formed from a large flexible sheet of nonwoven fabric which provides the clothing article with substantial strength, and which functions as a carrier for a relatively thin layer of polyvinyl alcohol gel. One surface of the gel layer has a release liner thereon, such as a thin perforated layer of polyethylene, which release liner adheres to the gel layer and effectively functions as the inside lining of the clothing article. The outer surface of the gel layer preferably has a plastic film removably but lightly adhered thereto to prevent any self-adherence between folded layers of the clothing article, which outer plastic film is removed when utilization of the clothing article is desired. The clothing article is formed by stitching the fire-retardant material together using conventional seaming techniques.

Other objects and purposes of the invention will be apparent to persons familiar with devices of this general type upon reading the following specification and inspecting the accompanying drawings.

Figure 1:
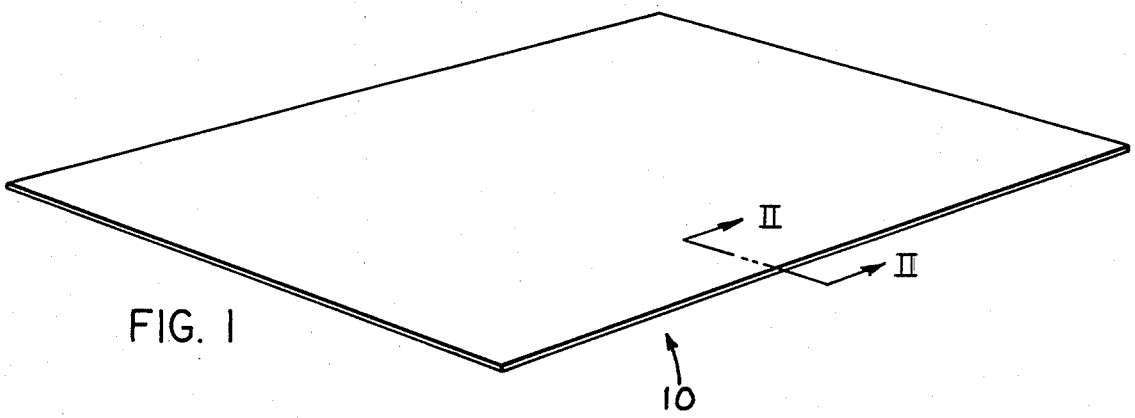
FIG. 1 is a perspective view of the improved blanket assembly according to this invention.

Certain terminology will be used in the following description for convenience in reference only, and will not be limiting. For example, the words "upwardly", "downwardly", "leftwardly" and "rightwardly" will refer to directions in the drawings to which reference is made. The words "inwardly" and "outwardly" will refer to the geometric center of the assembly and designated parts thereof. Said terminology will include the words specifically mentioned, derivatives thereof, and words of similar import.

DETAILED DESCRIPTION

Referring to the drawings, there is illustrated a blanket assembly 10 according to the present invention, which blanket assembly 10 is particularly desirable for use in smothering small fires or for use on burn victims, such as for putting out clothing fires. This blanket assembly 10 includes a basic fire blanket 11 having a removable film or layer 12 provided on one surface thereof.

The fire blanket 11 comprises a carrier sheet 16 of a flexible material or fabric, and more specifically a nonwoven polyester fabric. This carrier 16 functions as a porous substrate for holding a layer of gel 17. This gel 17 substantially penetrates the carrier 16 and also forms thin integral surface layers which substantially completely cover the opposite surfaces of the carrier. The blanket 11, as defined by carrier 16 and associated gel layer 17, hence effectively defines a sheetlike fire-retardant cloth.

The gel 17 is obtained by gelling an aqueous solution of polyvinyl alcohol which has previously been impregnated into the carrier 16. The gel 17 is formed, in situ in the carrier 16, by gelling an aqueous solution consisting essentially of about 5 to about 8 weight percent, preferably from about 6 to about 7 weight percent, of polyvinyl alcohol, and the balance is essentially water. It is well known that aqueous solutions of polyvinyl alcohol are coagulated by contacting same with various inorganic compounds. As inorganic compounds, there can be mentioned sodium borate and sodium carbonate, and in the present invention it is preferred to use sodium borate (borax) as the agent for gelling the polyvinyl alcohol aqueous solution because sodium borate is capable of rapidly insolubilizing the polyvinyl alcohol by a chemical cross-linking action. For example, treatment of the carrier 16 as previously impregnated with the polyvinyl alcohol aqueous solution, with an aqueous solution containing from about 2 to about 5 weight percent of sodium borate, will rapidly gel the polyvinyl alcohol in order to insolubilize same and to trap or occlude the water therein. The thus-formed gel has a solidlike consistency, is self-supporting, but very pliant.

Gelable polyvinyl alcohol solutions can be prepared by dissolving polyvinyl alcohol in water in accordance with conventional practice. Polyvinyl alcohols having various degrees of hydrolysis are commercially available from various manufacturers, with typical commercially available polyvinyl alcohols having a degree of hydrolysis of about 88 to about 100%. In the gel of the present invention, the polyvinyl alcohol is preferably all of the super hydrolyzed type, that is, having a degree of hydrolysis of 98% or more.

As to the carrier 16, this preferably comprises a nonwoven polyester fabric having a rating in the range of about 2 to about 2½ ounces per square yard.

The fire blanket 11 can be easily prepared by immersing the carrier 16 into a bath of an aqueous solution of polyvinyl alcohol so that the carrier becomes substantially completely impregnated with the aqueous polyvinyl alcohol solution and effectively forms thin surface layers thereon. Then the impregnated carrier is dipped in an aqueous solution of the coagulating agent, such as sodium borate, so as to transform the polyvinyl alcohol solution into a gel which totally impregnates the carrier 16 and effectively forms thin gel layers on opposite sides thereof, which gel layers effectively define the opposite side surfaces 18 and 19 of the blanket 11.

The thus-formed fire blanket 11 is readily flexible, and the surfaces 18 and 19 do not significantly adhere to the skin of a human or animal body. Further, this gel is non-irritating to the skin, and is non-toxic. However, this blanket is effectively self-sticking such that, if two layers of the blanket come into surface-to-surface contact, the layers can become quite securely stuck together so that separation thereof can be extremely difficult.

Accordingly, to prevent the blanket from becoming securely stuck together, while at the same time enabling the blanket 11 to be readily folded into a compact package, at least one of the surfaces, such as the surface 18, is provided with a thin removable plastic film 12 thereon. This plastic film 12 preferably comprises a thin flexible polyvinyl chloride (PVC) plastic film having a thickness in the range of one-half to one mil (0.001 inch), preferably three-fourths mil. This PVC film 12 does not tightly stick to the gel, but rather only lightly adheres to the gel surface 18 primarily due to a vacuum-type surface adhesion which is created when the film 12 is positioned over and pressed into contact with the gel surface 18. There hence creates a very slight adherence between the film 12 and the gel layer which is generally sufficient to hold the film in position, but at the same time enables the film to be easily manually engaged and manually removed from the gel layer.

The film 12 preferably comprises PVC since this does not tightly stick or adhere to the gel layer. Further, if the fire blanket is inadvertently utilized near flames without first removing the film layer 12, then the PVC film does not burn but merely shrinks away from the gel layer, and hence does not jeopardize the use of the blanket.

The blanket assembly 10 is typically sized so as to have a width of at least about four feet, and a length of at least about five or six feet, since such size is convenient for handling by one person, and is also convenient for use by one person in attempting to utilize the blanket as a protective covering when exposed to fire.

Figure 3:
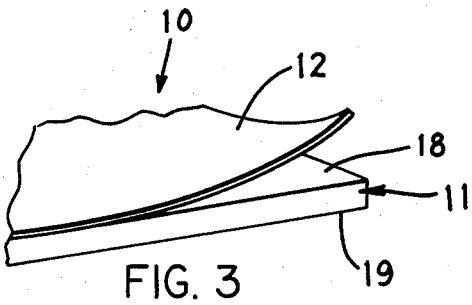
FIG. 3 is an enlarged, fragmentary perspective view illustrating one corner of the blanket with the plastic film partially removed therefrom.
Figure 2:
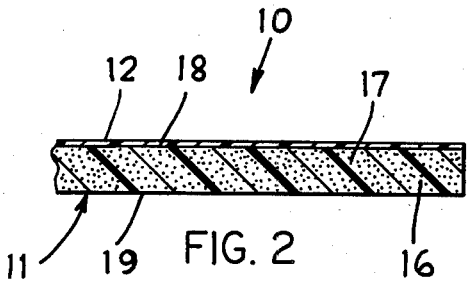
FIG. 2 is an enlarged fragmentary sectional view taken substantially along line II—II in FIG. 1.
Figure 4:
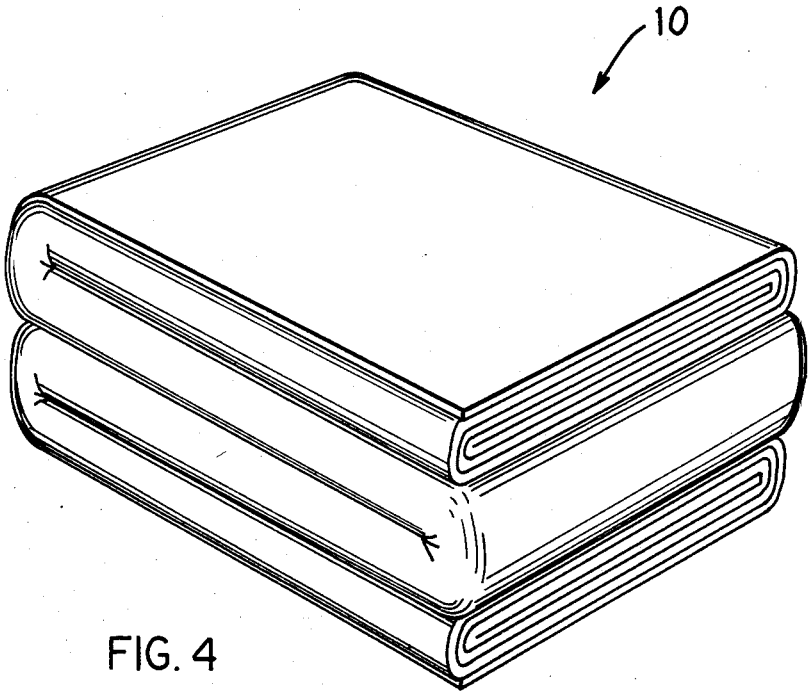
FIG. 4 illustrates the blanket assembly in its folded storage condition.

The fire blanket 11 typically and preferably has a thickness in the range of about 1/16 inch to about 3/32 inch (or about ¼ inch maximum) since this hence enables utilization of minimal PVA gel so as to minimize the cost and weight of the blanket, while at the same time the use of the nonwoven fabric 12 and its impregnation with the gel enables the blanket to have substantial strength so as to resist tearing or ripping. After the blanket assembly 10 has been formed as illustrated by FIGS. 1–3, then the blanket assembly is appropriately folded to facilitate handling and contact storage thereof. For example, the blanket assembly 10 is preferably folded longitudinally in a spiral or continuous-wraplike manner so as to form a series of overlapping layers, substantially as illustrated by FIG. 4, which overlapping or superimposed layers are effectively separated from one another by the plastic film 12 so as to prevent the superimposed layers from sticking or adhering to one another. After the blanket assembly has been spirally folded in a longitudinal direction, then it is also preferably folded in the transverse or widthwise direction to form a few superimposed layers substantially as illustrated by FIG. 4, whereby the resulting folded blanket assembly 10 hence effectively resembles a box-like structure of fairly small dimensions. For example, the blanket according to the present invention, such as a 50 inch by 72 inch blanket, when folded as illustrated by FIG. 4, will resemble a box having dimensions of approximately 9 inches by 13 inches by 3 inches. Further, the finished folded blanket has a weight of approximately 12 pounds. After the blanket assembly 10 has been folded as described above, it is then positioned within a suitable pouch or bag, such as a PVC plastic bag, the latter being preferably heat-sealed to enclose the blanket. The sealed pouch containing the folded blanket is then preferably subjected to gamma radiation to effect sterilization of the blanket. This exposure of the blanket to gamma radiation is also believed to increase the cross-linking of the PVA gel and to increase the resistance of the gel with respect to maintaining its integrity when subjected to high or low temperatures.

To use the blanket assembly 10 of the present invention, the folded blanket assembly is first removed from the sealed pouch, whereupon the blanket can then be opened or unfolded, such as by shaking it out. The film 12 can then be readily removed, whereupon the fire blanket 11 is hence in a condition for use, such as for smothering a small fire or for defining a protective wrap for the user. Due to the substantial amount of water which is trapped within the PVA gel, the blanket hence can create an effective protective wrap for the user so as to minimize the user's exposure to flames and/or heat.

Figure 5:
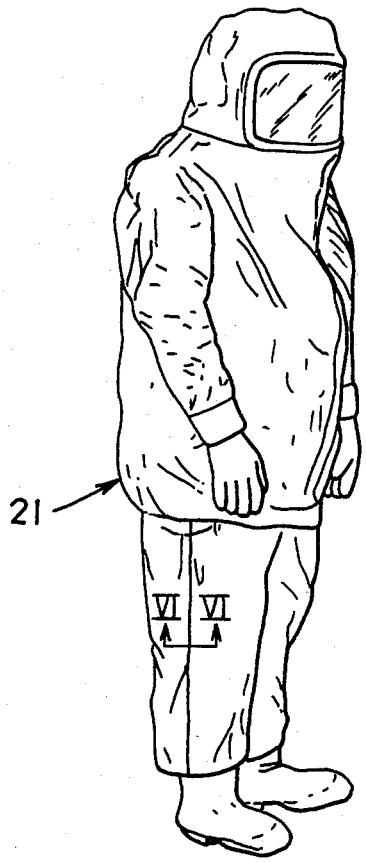
FIG. 5 diagrammatically illustrates a clothing article, specifically a fire-retardant suit, formed from the gellike sheet material of this invention.

The sheetlike fire-retardant material formed by carrier 16 and associated gel layer 17 can, in addition to its use as a fire blanket as described above, be utilized to form fire-retardant clothing articles, such as a fire-retardant suit as illustrated by FIG. 5. This suit 21 can have a conventional configuration in that it can be of one piece, or it can have a separate pant and jacket portion as illustrated by FIG. 5.

To create the fire-retardant clothing article from the fire-retardant sheetlike material, the material again employs the carrier 16 impregnated with the gel layer 17 as described above. However, the lower or inner surface 19 of the gel layer 17 is provided with a release liner 22 adhered thereto so as to effectively cover this lower surface 19. This release liner preferably comprises a thin plastic film which will readily adhere to the surface 19 of the gel layer 17, and in a preferred embodiment this release liner 22 comprises a thin polyethylene film having a thickness of about 1 mil. This liner or film 22 is preferably perforated with small holes since this hence greatly facilitates the snug adherence of the liner 22 to the gel layer 17. This liner 22 functions as the inner lining of the completed clothing article so as to prevent direct contact of the gel layer with the underlying clothing of the person wearing the clothing article. This liner 22 also performs an additional function in that it prevents the gel layers from directly sticking to themselves when the clothing article is being stored.

Figure 6:
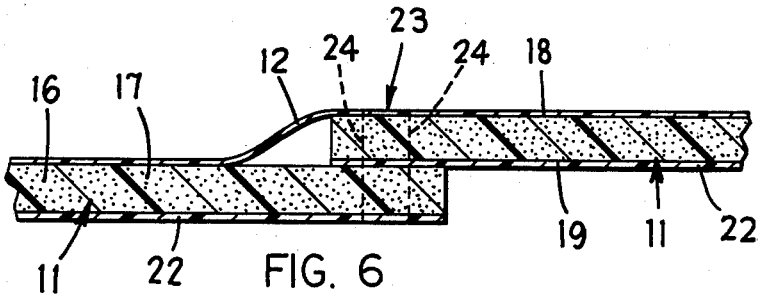
FIG. 6 is an enlarged, fragmentary sectional view taken substantially along line VI—VI in FIG. 5.

To form the clothing article 21 from the fire-retardant material (that is, the carrier 16, gel layer 17, and liner 22), the sheetlike material can be suitably cut to the desired size and shape so as to permit forming of some or all of the clothing article, and the clothing article can be formed by use of substantially conventional seams. For example, the edges of the fire-retardant material can be suitably overlapped as illustrated by FIG. 6 to create a seam 23, which overlapped edges are suitably secured together by conventional stitching 24. After creation of the clothing article, the outer surface 18 of the gel layer is again preferably provided with the removable film 12 positioned thereover so as to prevent the outer surfaces of the gel layer from directly adhering to one another when the clothing article is stored, such as in a folded condition. However, this outer film 12 is preferably removed, as by peeling it off of the gel layer, prior to utilization of the clothing article.

The carrier 16 having the gel layer 17 impregnated therein is formed in the same manner described above relative to the fire blanket. However, after the impregnated carrier 16 is dipped in the aqueous solution so as to effectively form the gel layer 17, then the thus-formed sheet structure has the liner 22 applied to the surface 19, which liner 22 adheres to the surface due to the residual stickiness of the surface 19 and due also to the small holes or perforations formed in the film 22, which perforations permit limited penetration of the gel to create an intimate adhering of the film to the gel surface.

While the construction of the clothing article 21 has not been described in detail, nevertheless such construction from a sheetlike material is conventional, and hence such conventional construction is utilized in the present invention except that the improved fire-retardant material of this invention is utilized for forming of the clothing article. In addition to clothing articles such as pants, parkas and ponchos, the fire-retardant material of this invention can also be utilized for construction of other fire-retardant articles such as gloves, boots and the like.

The liner 22 can also be provided on the surface 19 of the fire blanket illustrated in FIGS. 1–4 if desired, although use of such liner 22 is not believed necessary since the removable film 12 is sufficient to prevent the blanket from adhering to itself if properly folded. Further, the blanket, without the liner 22, hence has two surfaces which are usable for direct application to a fire, whereas the presence of the liner 22 results in one surface of the blanket being less suitable for use directly against a fire, although the presence of such liner on the blanket does make the blanket more suitable for use as direct protection for a person trapped by a fire since the liner can hence be positioned on the inside of the blanket for direct contact with the person.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a fire-retardant appliance constructed from a sheetline fire-retardant material, the improvement wherein said fire-retardant material comprises:

a thin, flexible, sheetlike structure having length and width dimensions which are large relative to its thickness dimension, said structure consisting essentially of a thin, substantially planar, flexible, permeable substrate which is impregnated and filled with a non-toxic gel which is non-irritating to the human skin, said gel consisting essentially of gelled polyvinyl alcohol containing occluded water so that the gel is substantially self-supporting and has a solidlike consistency, said gel being formed by impregnating said substrate with an aqueous solution containing polyvinyl alcohol and the balance of the solution being essentially water, said polyvinyl alcohol being coagulated with a coagulating agent to insolubilize said polyvinyl alcohol and trap the water therein, said sheetlike structure defining enlarged opposite side surfaces, said gel substantially totally impregnating said permeable substrate and forming thin gel layers on opposite sides thereof which define said opposite side surfaces, and a thin and flexible film disposed in superimposed relationship to one of the side surfaces of said sheetlike structure.

2. An appliance according to claim 1, wherein the film is perforated with small holes throughout so that the gel tends to slightly penetrate the holes to increase the adherence of the film to the gel so that the film can not be readily manually removed.

3. An appliacne according to claim 2, including a thin and flexible film disposed in superimposed relationship to the other of the side surfaces of said sheetlike structure, said film having only a light surface adhesion with said gel so that the film can be readily manually removed from the sheetlike structure.

4. An appliance according to claim 1, wherein the film has only a light surface adhesion with said gel so that the film can be readily manually removed from the sheetlike structure.

5. A blanket usable for protection against fire, comprising:

a thin, flexible, sheetlike structure having length and width dimensions which are large relative to its thickness dimension, said structure consisting essentially of a thin substantially planar, flexible, permeable substrate which is impregnated and filled with a gel, said gel consisting essentially of gelled polyvinyl alcohol containing occluded water so that the gel is substantially self-supporting and has a solidlike consistency, said gel being formed by impregnating said substrate with an aqueous solution containing from about 5 to 8 weight percent of polyvinyl alcohol and the balance being essentially water, said polyvinyl alcohol being coagulated with a coagulating agent to insolubilize said polyvinyl alcohol and trap the water therein, said gel being capable of adhering to itself and not being capable of strongly adhering to the skin of a human, said sheetlike structure defining enlarged and substantially planar opposite side surfaces, said gel extending to said opposite side surfaces so that the sheetlike structure is pressure-sensitive and will adhere to itself, said side surfaces being cool and moist but not wet, and a thin and flexible film disposed in superimposed relationship to one of the side surfaces of said sheetlike structure, the other side surface being uncovered, said film having only a light surface adhesion with said sheetlike structure so that the film can be readily manually removed from the sheetlike structure so as to uncover said one side surface when use of the blanket is desired.

6. A blanket according to claim 5, wherein the sheetlike structure has a maximum thickness of about one-fourth inch, wherein the width and length dimensions of the sheetlike structure are at least about 200 times greater than said thickness, and wherein said releasable film comprises polyvinyl chloride having a thickness of about one-half to about one mil.

7. A blanket according to claim 1, wherein the sheetlike structure with the film thereon is folded in a spiral-like fashion along one of the length and width dimensions thereof so that the sheetlike structure defines several superimposed layers which are separated from one another by said releasable film, and the spirally wound sheetlike structure being folded in the other of said length and width dimensions to form several superimposed layers disposed in an accordian-style fold.

8. A blanet according to claim 7, including a sealed pouch disposed in surrounding relationship to the folded sheetlike structure.

9. A blanet according to claim 5, wherein said sheetlike structure has a thickness of from about 1/16 to about ¼ inch, a width of at least about 48 inches, and a length which equals or exceeds said width.

10. A blanet according to claim 5, wherein the blanket is folded, and a sealed pouch disposed in surrounding relationship to the folded blanket, the blanket being sterilized by subjecting it to gamma radiation.

* * * * *